United States Patent [19]

Valditerra

[11] Patent Number: 4,643,100

[45] Date of Patent: Feb. 17, 1987

[54] RAILWAY TRAIN SET FOR THE RENEWAL OF RAILWAY TRACKS, WITH SUPPORT AND ADVANCEMENT GUIDE MEANS

[76] Inventor: Enrico Valditerra, Viale Rimembranze 67, I-15067 Novi Ligure Alessandria, Italy

[21] Appl. No.: 748,608

[22] Filed: Jun. 25, 1985

[30] Foreign Application Priority Data

Jul. 10, 1984 [IT] Italy ..... 67701 A/84

[51] Int. Cl.[4] ..... E01B 29/05

[52] U.S. Cl. ..... 104/2; 104/6

[58] Field of Search ..... 104/2–6, 104/9; 105/171

[56] References Cited

U.S. PATENT DOCUMENTS

| | | | |
|---|---|---|---|
| 396,633 | 1/1889 | Weems | 104/303 |
| 4,249,467 | 2/1981 | Theurer et al. | 104/3 |
| 4,325,306 | 4/1982 | Valditerra | 104/2 |

FOREIGN PATENT DOCUMENTS

| | | | |
|---|---|---|---|
| 0610841 | 12/1960 | Canada | 104/2 |
| 0825626 | 12/1959 | United Kingdom | 105/171 |

*Primary Examiner*—Robert B. Reeves
*Assistant Examiner*—Scott H. Werny
*Attorney, Agent, or Firm*—Young & Thompson

[57] ABSTRACT

A railway train set intended for the renewal of railway tracks, comprising an operative assembly provided with apparatus for removing the old rails, and with apparatus for allowing at least one of the axles to advance on the railway track already deprived of the rails, this latter apparatus comprising an auxiliary bogie which is liftable and lowerable. Rail sections are provided which are disposed, during the working periods, below the auxiliary bogie and below the axle in question of the operative assembly, respectively, for being travelled on while resting on the underlying sleepers. There is structure for displacing forward in a longitudinal direction the first and second rail sections during the periods in which they are not subjected to the load of the weight of the vehicle.

4 Claims, 2 Drawing Figures

RAILWAY TRAIN SET FOR THE RENEWAL OF RAILWAY TRACKS, WITH SUPPORT AND ADVANCEMENT GUIDE MEANS

BACKGROUND OF THE INVENTION

This invention relates to a railway train set for the renewal of railway tracks, comprising an operative assembly provided with means for removing the old rails, and with means for allowing at least one of the axles to advance on the railway track already deprived of the rails.

There are several known types of railway vehicles or train sets which can be displaced (by their own means or attached behind other train sets) on railway tracks for being transferred from a depot to a working area where, after having reached it, they perform by, mechanised means, the operations of removing the rails to be substituted, removing the old sleepers, levelling or displacing or scarifying the ballast, laying the new sleepers, and finally laying the new rails in lieu of the former ones. The support and guidance of such a railway train set may be entrusted to the pre-existent track only in the leading part of the train set, because beginning from the point at which the rails have been removed the support and guidance provided by the track are missing. It is therefore necessary to provide special support means, different from a simple axle or bogie, which usually are formed by crawler supports resting on the ballast, and are not satisfactory. More advanced devices have also been proposed, which comprise a sliding shoe with rollers or crawlers which is disposed beneath the axle of the vehicle and slides on the old sleepers that are still installed, but in this case difficulties arise, which are due to the fact that the displacement of the sliding shoe takes place under the entire load to which the axle is subjected.

SUMMARY OF THE INVENTION

The object of this invention is to improve the known railway train sets intended for the hereinabove described purpose, by providing for them a support and advancement guide device capable of allowing the railway train set to proceed on the railway track already deprived of the rails, by following the correct path, and which should be free from the disadvantages of the known device or present them to a smaller extent.

The railway train set according to this invention, comprising an operative assembly provided with means for removing the old rails, and with means for allowing at least one of the axles to advance on the railway track already deprived of the rails, is mainly characterized in that said means for allowing an axle to advance on the railway track already deprived of the rails comprise: an auxiliary liftable and lowerable bogie, also suitable for being displaced in a transversal direction; means for controlling the lifting and the lowering of said auxiliary bogie; means for locking said auxiliary bogie in the transversal position attained; first and second sections of rail suitable for being disposed, during the working periods, below said auxiliary bogie and below the axle in question, respectively, in order to allow them to travel thereon, and first and second means for displacement said first and second rail sections forward in a longitudinal direction.

Thanks to these characteristics, the operative assembly of the railway train set according to the invention (which may be preceded, as usual, by stocking cars which carry the new equipment to be laid and are intended to receive the old equipment which has been removed, and followed by other vehicles carrying operative means) travels, with one or more axles preceding the axle being considered, on the railway track to be renewed, previously deprived of the attachment members, carries out the removal of the old rails, and advances with the axle in question on the old sleepers that are still installed with the interposition of rail sections resting on the sleepers (or on the rail holder plates in case of these latter being present on the sleepers) and guided by them, whereby the assembly is supported in a correct manner and follows the pre-existing path exactly. The advancement of each rail section is carried out while the corresponding axle, or auxiliary bogie, is not subjected to any load, and therefore there is no danger either of difficulties to the advancement of the rail sections or of displacement of the sleepers.

Preferably, moreover, said means for allowing at least one of the axles to advance on the railway track already deprived of the rails also comprise detecting means arranged to detect the approaching of the front and rear ends of said auxiliary bogie and said axle, respectively, the length of movement on said rail sections, and conventional computer means for coordinating the operation of said parts, controlled by said detecting means and arranged to produce, alternatively for said axle and for said auxiliary bogie, the transfer of the load onto the other of them and the advancement of the unload rail sections, as well as to produce the locking of the transversal displacement of the auxiliary bogie within the only periods in which the load is applied thereon.

Thanks to these further characteristics, the opration of the support and advancement guide means of the train set is completely automatic and does not require either action or control by the operators.

BRIEF DESCRIPTION OF THE DRAWINGS

These and other particularities and the advantages of the invention will be better apparent from the following description of an embodiment, given by way of non limiting example and diagrammatically shown in the annexed drawing, in which.

DETAILED DESCRIPTION OF THE PREFERRED EMBODIMENTS

Figure 1:
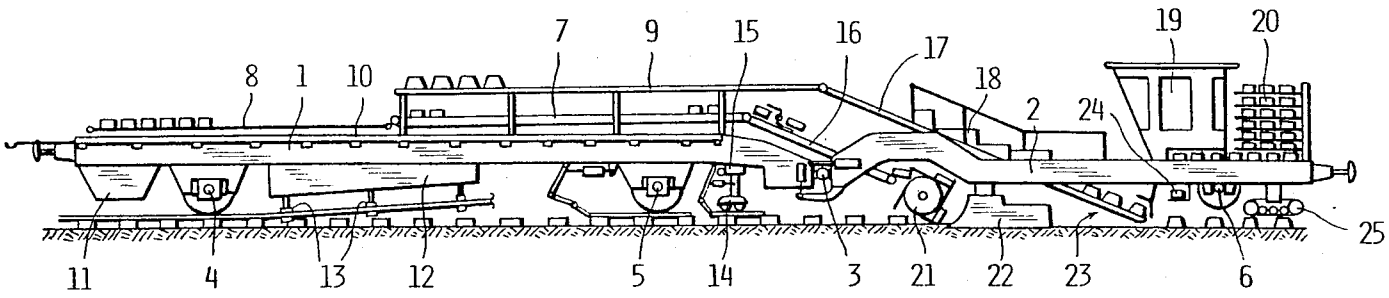
FIG. 1 is a side view, on a small scale, of the operative assembly according to the invention, formed by two vehicles.

A railway train set for the renewal of railway tracks, according to this invention, generally comprises an operative assembly as shown in FIG. 1 (arranged to advance from the right-hand to the left-hand side according to the drawing), further operative means, per se known, mounted on cars, not shown, which follow the operative assembly, and a certain number of stocking cars intended to carry the new equipment which has to be laid, and to receive the removed old equipment, said cars being disposed to precede (in the advancement direction of the train set) the operative assembly of FIG. 1.

The operative assembly of FIG. 1 comprises two vehicles defined by their frames 1 and 2, which are spherically articulated to one another at 3. The frame of the vehicle 1 has a first axle 4 and a second axle 5 (which however could be substituted by corresponding bogies), whilst the frame of the vehicle 2 rests at front, through the articulation 3, on the frame 1, and rests at rear on its own axle 6 (which could as well be substituted by a bogie).

The frame 1 of the first vehicle supports, on the upper portion, a conveyor 7 which leads to a store 8 for the removed old sleepers, a store 9 for the new sleepers to be laid, and a service track 10 for a portal conveyor (per se known and not shown) intended to handle the equipment between the stores 8 and 9 and the stocking cars which precede the operative assembly 1–2. Furthermore, the frame 1 carries, in its lower portion, a motor set 11, generally a Diesel engine which actuates a hydrodynamic power station and an electric generator for feeding the various operating members of the assembly, a frame 12 provided with roller tongs 13 disposed (in a manner per se known) for lifting and moving away from the underlying sleepers the old rails which have to be removed, and an auxiliary bogie 14 (liftable by means of a hydraulic cylinder 15) which pertains to the means intended to allow the second axle 5 to advance on the old sleepers already deprived of the rails, which means will be described in more detail later on with reference to FIG. 2.

The frame 2 of the second vehicle carries, on its upper portion, a conveyor 16 which leads to the conveyor 7 of the first vehicle, for the new sleepers to be laid, a railing-step board 18 for the survey of the laying operations and for possible actions on the respective mechanisms, an operator's cabin 19 and a store 20 for special sleepers to be laid in particular locations, such as for example at level-crossings. On the lower portion the frame 2 carries a device 21 for the removal of the old sleepers, which are then fed to the conveyor 16, a share 22 for levelling or removing the ballast, a unit 23 for laying the new sleepers, a distributor 24 for the special sleepers coming from the store 20, and a crawler support 25. This latter assembly, which is lifted for the approaching travel on the tracks when the axle 6 is operating, is lowered (to the position shown in the drawing) during the working operations, and allows the second vehicle 2 to procede by resting on the new sleepers that were just laid, which are still without rails (or, according to a possible alternative, sideways said sleepers).

The hereinabove described operative assembly acts by advancing in a continuous manner towards the left according to FIG. 1, running by means of the axle 4 on the old rails deprived of the bolts, lifting and moving away the old rails by the means 12–13 while the old sleepers remain laid on the ballast, sliding on these old sleepers (as will be described later on) by means of the axle 5 and the auxiliary bogie 14, removing by means of the removal device 21 the old sleepers which the conveyors 16 and 7 carry to the store 8, levelling or displacing or scarify the ballast by means of the share 22 and the associated operative means, and laying by means of the devices 23 and 24 the new sleepers, on which the assembly advances by means of the crawler support 25. The further operations (laying the new rails, compacting the ballast, and so on) are then carried out by subsequent operating means, not shown.

Figure 2:
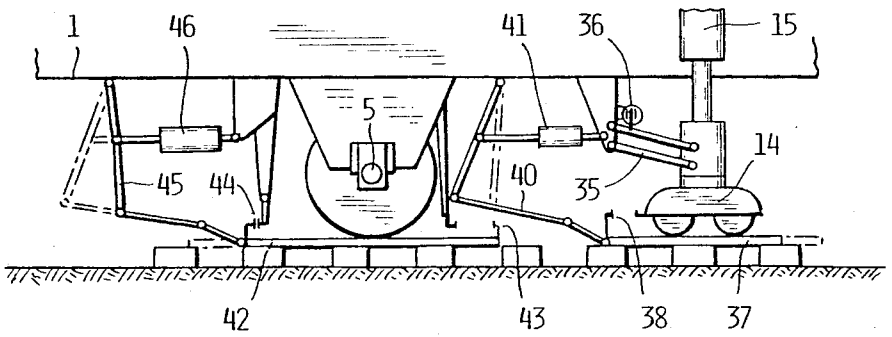
FIG. 2 is an enlarged view showing the means for allowing the second axle of the first vehicle to advance on the sleepers deprived of rails.

Referring now to FIG. 2, the device for allowing the second axle 5 of the vehicle 1 to advance on the old sleepers, which in the region of said axle are already deprived of the old rails removed by the means 12–13, comprise an auxiliary bogie 14 which is liftable and lowerable by means of a hydraulic cylinder 15. In the lifted position, the bogie 14 does not contact the rails and does not hinder the travel of the railway train set, whilst in the lowered position it may discharge from the axle 5 the load of the frame 1, which is absorbed by the bogie 14 through the cylinder 15 under pressure, or it may simply rest on the rails without any load, when cylinder 15 is not under pressure. The lifting and the lowering of the bogie 14 are guided by a suitable kinematic system, for example a parallelogram 35. In addition thereto, the bogie 14 is allowed to perform a transversal displacement which, however, may be locked by a hydraulic cylinder 36. During the working periods, there are short rail sections 37, disposed on the sleepers, below the bogie 14 which cooperate with the bogie 14 by means of a position detector 38 and which, by means of a lever system 40, may be moved in a longitudinal direction by a hydraulic cylinder 41. Similarly, during the working periods, rail sections 42, provided with position detectors 43 and 44, are laid onto the old sleepers below the axle 5 and, by means of a lever system 45, may be displaced longitudinally by an hydraulic cylinder 46.

The operation of this device is as follows. During the working advancement of the railway train set, the rail sections 37 and 42 are disposed below the bogie 14 and below the axle 5, respectively, and rest on the rail holder plates of the underlying sleepers, which guide them according to the path of the line. In the cases in which the equipment does not contemplate the use of rail holder plates, the rail sections 37 and 42 rest directly on the upper portion of the sleepers. During a first step, the axle 5 (which, in this step, is subjected to the weight of the frame 1) advances on the rail sections 42, which remain stationary relative to the underlying sleepers. Cylinder 15 is inactive and therefore the bogie 14 is not under load. During this step of advancement, in which the load acts on the axle 5, cylinder 41 is active and makes the rail sections 37 advance relative to the underlying sleepers and relative to the bogie 14; this does not present any difficulty since the bogie 14 is free from any load. This advancement of the rail sections 37 relative to the bogie 14 continues until the activity of the cylinder 41 is interrupted by the position detector 44. This latter also activates the cylinder 15, which transmits the load of the frame 1 to the auxiliary bogie 14, and therefore discharges the axle 5, and furthermore it activates the cylinder 46. At this point a second step is started, in which the bogie 14 (which is now subjected to the weight of the frame 1) advances on the rail sections 37, which remain stationary relative to the underlying sleepers. During this advancement step in which the load exerts its pressure on the bogie 14, cylinder 46 which has been activated causes the rail sections 42 to advance relative to the underlying sleepers and relative to the axle 5: this presents no difficulty, because the axle 5 has no load acting thereon. This advancement of the rail section 42 relative to the axle 5, and the step of advancement of the vehicle resting on the bogie 14, continue until the position detectors 43 and 38 interrupt the activity of the cylinder 46, deactivate the cylinder 15 and activate the cylinder 41; accordingly, the axle 5 is again subjected to the load of the frame 1. At this point, the cycle of operation is terminated, and the two steps described hereinabove continue to be repeated in a cyclic manner, thus allowing a continuous advancement of the vehicle. Thus, the advancement on the sleepers deprived of rails takes place by alternate forward displacements of the rail sections 37 and 42, while the load of the advancing vehicle is always exerted on stationary rail sections, and the rail sections which are being displaced forward are always those which are situated below a support means which in that step is not subjected to any load.

Cylinder 36 is connected in such a manner as to leave free the transversal displacement of the bogie 14 while the load of the vehicle is applied to the axle 5, and to lock the lateral displacement of the bogie when the load of the vehicle is transferred onto the bogie 14. In this way, the bogie 14 has the possibility of adapting its own transversal position, as a function of the local curvature of the track path, during the entire period in which the transversal position of the vehicle is defined by the axle 5, and maintains then unvaried such transversal position during the period in which the bogie 14 supports the load. In order to leave the axle 5 the maximum possible control of the transversal position of the vehicle, it is preferred that the advancement travel of the rail sections 42 be considerably greater than that of the rail sections 37, and the load be transferred to the bogie 14 for a time strictly limited to the period of time needed for the displacement of the rail sections 42. For example, the length of displacement of the rail sections 42 may be about 40 cm, and the length of displacement of the rail sections 37 may be about 20 cm.

The device according to the invention has been described with reference to the second axle 5 of a vehicle 1 having two axles 4 and 5, having the means 12, 13 for moving away the old rails disposed between the two axles, and followed by another vehicle 2 having a single axle 6. It is to be understood, however, that a similar device may advantageously be used for supporting and guiding the axle 6 of the second vehicle, in lieu of the crawler support 25. Moreover, in the cases in which the means 12, 13 for removing the old rails are not disposed after the axle 4 of the vehicle 1, but on a car which precedes the vehicle 1 in the railway train set, a device like that described may also find application for supporting and guiding the first axle 4 of the vehicle 1. In this case, the operation of the machine is improved by reducing to negligible levels the internal stresses induced in the rails during the operation of removal thereof.

At the end of the operation of substitution of a track length, the rail sections 37 and 42 could be removed. However, preferably, the rail sections 42 are arranged to be left installed, by fastening them to the plates or to the underlying sleepers by the normal attachment members, and by connecting them, by means of the usual fish-plates, on one hand to the old track not yet renewed, and on the other hand to the new rails just installed, thus establishing the continuity of the rails needed for the transit of railway train sets on the railroad. This operation facilitates in a substantial manner the interruption and the restoration of the activity of the railway train set when the renewal work is effected on a railroad which must remain in use.

The described device shows an operation reliability considerably higher than that of the known devices, even those more advanced in which a roller shoe or a crawler shoe is disposed below the axle of the vehicle, since said shoe is intended to slide on the sleepers under the entire load to which the axle of the vehicle is subjected and thus may encounter difficulties, resistances or hindrances to its advancement, or it may displace the old sleepers, resulting in the upsetting of the path on which the shoe has to slide.

it is to be understood that the train set according to the invention may have all the characteristics described herein or also only a part thereof, according to the particular applications for which it is intended. Different modifications may be made to the details described, and all parts and groups of parts may be substituted by their technically equivalent means.

I claim:

1. A railway train set intended to be used for the renewal of railway tracks, comprising an operative assembly having means for removing the old rails, at least one axle intended to advance on the railway track already deprived of the rails, and means for allowing said axle to advance on the railway track already deprived of the rails, wherein said means for allowing said axle to advance on the railway track already deprived of the rails comprise: an auxiliary bogie, mounted on said operative assembly for lifting and lowering displacements; means for controlling the lifting and lowering displacements of said auxiliary bogie; first and second rail sections adapted to be disposed, during periods of operation, below said auxiliary bogie and below said axle, respectively, in order to allow them to travel thereon, and first and second means for displacing forward said first and second rail sections in a longitudinal direction whereby said first and second rail sections are alternately loaded and unloaded as said auxiliary bogie is raised and lowered and can be shifted forward when unloaded.

2. A railway renewal train set as claimed in claim 1, wherein said means for allowing said axle to advance on the railway track already deprived of the rails further comprise detecting means arranged for detecting the approach of said auxiliary bogie and said axle to the front and rear ends, respectively, of said rail sections, and means for coordinating the operation of said means for allowing said axle to advance on the railway track already deprived of the rails, controlled by said detecting means and disposed to raise, alternately said axle and said auxiliary bogie, to transfer the load onto said auxiliary bogie and onto said axle, respectively, and to advance the respective rail sections, as well as to activate said means for locking the transversal displacements of the auxiliary bogie during the periods in which the load acts on said auxiliary bogie.

3. A railway renewal train set as claimed in claim 2, wherein said means for displacing said rail sections in a longitudinal direction comprise lever systems actuated by hydraulic cylinders.

4. A railway renewal train set as claimed in claim 2, wherein said means for displacing said rail sections in a longitudinal direction are arranged to carry out movements of lengths considerably different from one another, the length of movement of the rail sections coordinated to said axle being greater than the length of movement of the rail sections coordinated on said auxiliary bogie.

* * * * *